United States Patent [19]

Bailey

[11] Patent Number: 4,690,655

[45] Date of Patent: Sep. 1, 1987

[54] TALKING MARIONETTE WITH THEATRE

[76] Inventor: Samuel G. Bailey, 815 S. 18th St., Apt. 200, Arlington, Va. 22202

[21] Appl. No.: 880,994

[22] Filed: Jul. 1, 1986

[51] Int. Cl.[4] ..... A63J 19/00

[52] U.S. Cl. ..... 446/84; 446/139; 446/297; 446/362; 446/376; 446/384

[58] Field of Search ..... 446/84, 83, 82, 139, 446/297, 338, 330, 359, 361, 362, 363, 376, 384

[56] References Cited

U.S. PATENT DOCUMENTS

| | | | |
|---|---|---|---|
| 1,874,819 | 8/1932 | Simmons | 446/84 |
| 2,621,440 | 12/1952 | Stone | 446/83 |
| 2,637,138 | 5/1953 | Doran et al. | 446/83 |
| 2,671,161 | 3/1954 | Johnson | 446/82 X |
| 3,304,649 | 2/1967 | Fosser | 446/84 X |
| 3,384,074 | 5/1968 | Rautiola et al. | 446/297 X |
| 3,742,645 | 7/1973 | Casey | 446/139 |
| 4,075,780 | 2/1978 | Linebaugh | 446/84 |
| 4,169,335 | 10/1979 | Betancourt | 446/297 |
| 4,516,950 | 5/1985 | Berman et al. | 446/297 |

*Primary Examiner*—Philip C. Kannan
*Attorney, Agent, or Firm*—Dennis P. Clarke

[57] ABSTRACT

An amusement device comprising a marionette possessing lifelike qualities, including the appearance of ability to speak through a coordination of head movements and audio input to a speaker disposed in the mouth area of the marionette, provided with a theatre setting for use with the marionette when a realistic setting is desired.

11 Claims, 12 Drawing Figures

TALKING MARIONETTE WITH THEATRE

BACKGROUND OF THE INVENTION

1. Field of the Invention

The present invention relates to amusement devices and more particularly to a talking marionette and an accompanying theatre setting.

2. Description of the Prior Art

Marionettes, or string-operated puppets, are well known in the art as toys or amusement devices. The entertainment value of these marionettes is derived from being able to remotely provide a normally inanimate object with animate characteristics such as limb movement. Also known is that additional enjoyment is gained when the marionette is used in combination with a stage. This provides an added measure of realism to the toy, as the marionettes appear as actors and actresses would on a real theatre stage.

Variations and improvements on the marionette as an amusement device are also known in the art. Different methods of actuating movement in the marionette are among these.

Also, hand-held dolls or figures have been disclosed in which sound resembling speech is emanated from inside the figure. United States letters patent issued to Berman, U.S. Pat. No. 4,516,950, and Baer, U.S. Pat. No. 4,540,176, are representative of these devices.

SUMMARY OF THE INVENTION

The amusement device of the present invention includes a marionette operated by control lines and possessing various features simulating qualities possessed by humans. A stage and theatre setting including a simulated audience and other realistic features are provided in the present invention also.

The marionette of the present invention has a two-piece hinged head, the top portion of which is pivoted about the hinge using a control string attached to the forehead. This gives the appearance that the marionette's mouth is opening and closing. A speaker is provided in the lower portion of the head in what would be the lower gum area in a real mouth. It is connected to a remote audio input source by wire. A coordination of mouth movement and sound emanation will produce the impression that the marionette is speaking or singing.

Other animate features of the marionette provided in the present invention are magnetized hands and fluorescently painted face, eyes, hands, and feet/shoes.

It is an important object of the present invention to provide an amusement device which includes a marionette capable of exhibiting several lifelike qualities, including the appearance of ability to speak.

It is a further object of the present invention to provide a scaled down realistic setting for use with the marionette, enhancing the entertainment value of the marionette.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout the several views.

DESCRIPTION OF A PREFERRED EMBODIMENT OF THE INVENTION

Figure 1:
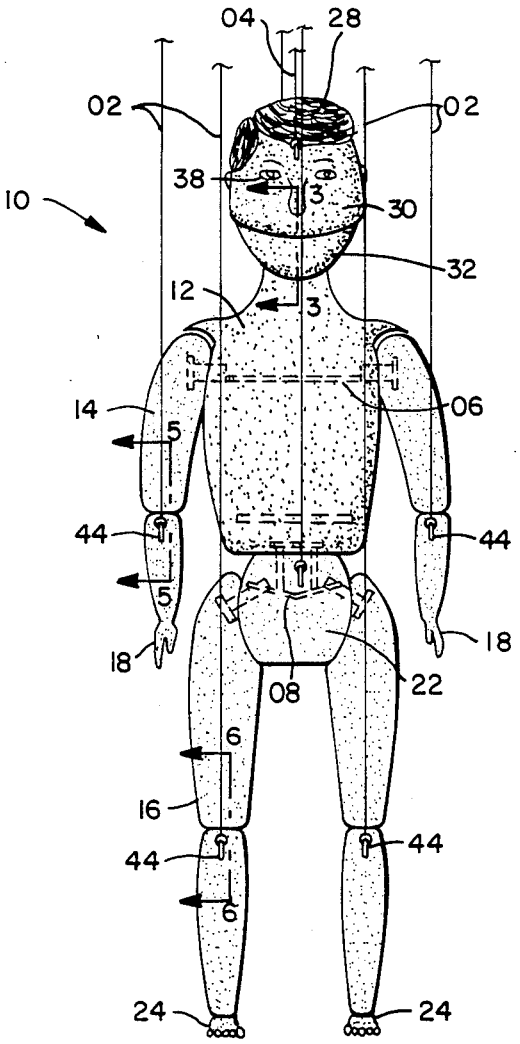
FIG. 1 is a front elevation view of the marionette according to the present invention.

Referring intially to FIG. 1 of the drawings, the marionette 10, in a preferred embodiment of the invention is constructed to resemble a human body. The marionette 10 has movable arms 14, legs 16, lower torso 22, and a head 28 with an upper movable portion 30. The marionette 10 is suspended from control lines 02. Hooks 44 located on the arms 14, legs 16, and feet 24 are adapted to engage control lines 02 for creating movement of the limbs upon actuation by the control lines 02. Torso hooks 46 (FIG. 2) are adapted to engage control lines 02 and are used to support the marionette 10 without using a line to the head 28 of the marionette 10 for body support, allowing the head 28 to be operated to simulate mouth opening and closing. The torso hooks 46 with their associated control lines 02 provide control in moving the entire body of the marionette 10, or to cause the lower part of the body to twist relative to the upper torso 12. The head hook 48 is adapted to engage a head control line 04 to allow control of the upper movable portion 30 of the head 28, and also to allow rotation of the head 28 relative to the upper torso 12.

In the preferred embodiment the face 20 is designed with standard human features, and the face 20, eyes 38, hands 18, and feet/shoes 24, are fluorescently painted to give an added measure of animation to the marionette 10. In addition, it is preferred that the hands 18 be made of a magnetic material, that is, one which will retain a magnetic charge so that they will be capable of holding objects, such as a dummy microphone, which are susceptible to magnetic attraction. This further adds to the marionette's lifelike qualities.

FIG. 1 also shows, in ghost lines, the shoulder joint mechanism 06 and the hip joint mechanism 08, which allow limb movement at those joints.

Figure 2:
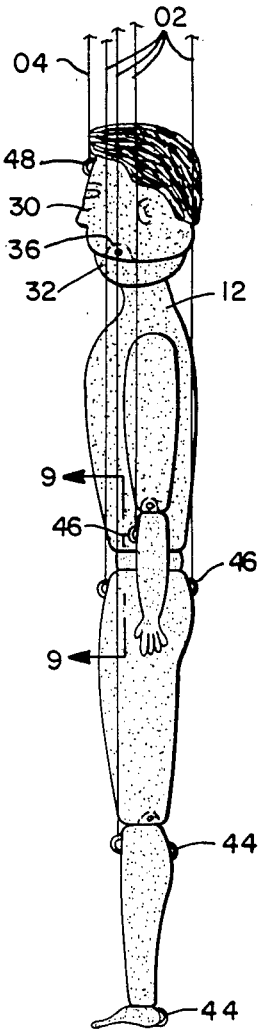
FIG. 2 is a side elevation view of the marionette of FIG. 1.

FIG. 2 shows how the marionette 10 can be operated to simulate mouth movement. A jaw hinge 36 pivotably attaches the upper movable portion 30 of the head 28 to the lower attached portion 32, which is fixed by attachment to the upper torso 12.

The two portions of the head 28 are joined by the jaw hinge 36 in such a manner that the rest position resembles a closed mouth with the front part of the upper movable portion 30 resting on the front part of the lower attached portion 32.

The mouth opening operation consists of raising head actuation line 04 which is engaged with head hook 48, pivoting the upper movable portion 30 about the lower attached portion 32. The front part of the upper movable portion 30 travels up, and the rear part travels down, opening a gap between the upper movable portion 30 and the lower attached portion 32 on the face 20 of the marionette 10. This is the open mouth position. Closing of the mouth is accomplished by lowering the head actuation line 04, allowing the upper movable portion 30 to return to its original position. This operation can be performed repeatedly, and the operator can vary the extent to which the mouth is opened with the head actuation line 04. A realistic simulation of mouth movement used in speech can thus be attained.

Figure 3:
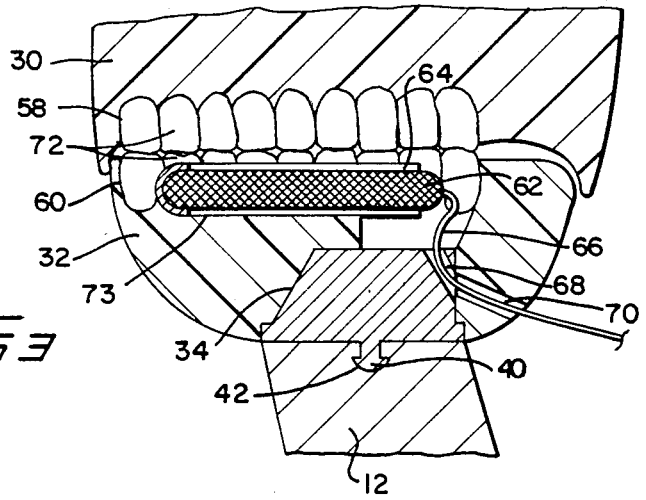
FIG. 3 is a sectional view taken along line 3—3 of FIG. 1.
Figure 4:
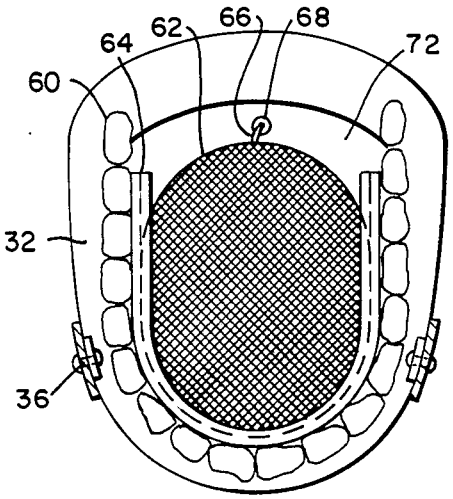
FIG. 4 is a top plan view of the lower head portion according to the invention.

FIGS. 3 and 4 show the simulated human features in the mouth area of the head 28. Rows of upper teeth 58 and lower teeth 60 are fixed along the front and side walls of the mouth recesses 72 in the upper movable portion 30 and lower attached portion 32 of the head 28.

A loudspeaker 62 mounted in a bracket 64 is disposed in the recess 72 in the lower attached portion 32 and occupies nearly the entire area surrounded by the lower teeth 60. The bracket 64 is fixed by attachment to either the lower teeth 60 or the floor 73 of the recess 72 in the lower attached portion 32. A speaker wire 66, connecting the loudspeaker 62 to a remote audio input source, exits from the rear of the lower attached portion 32 through a bore 68 in the removable head plug 34 and through a corresponding bore 70 in the lower attached portion 32, thus staying hidden from a viewing audience. The audio input source in this preferred embodiment of a human-like marionette 10 would preferably transmit sounds made by humans, either through a microphone or tape or record playback means. Having the loudspeaker 62 located in the area where a tongue would be found in a human gives the effect of having the sound emanate directly from the mouth, instead of somewhere inside the body. When this feature is used in combination with a corresponding manipulation of head movement described previously, a realistic simulation of a speaking person is attained. As an added measure of realism, a red or pink cloth cover for the loudspeaker 62 can be provided, making the loudspeaker 62 look like a tongue as well.

FIG. 3 also shows the construction and method of attachment of the lower attached portion 32 of the head 28. The base of the lower attached portion is hollow, and is fitted with a removable head plug 34. The head plug 34 carries a male element 40 of a snap attachment which is received by a corresponding female element 42 disposed at the top surface of the upper torso 12. This allows the head to rotate through a full 360°. As can be seen, the upper torso 12 is also angled slightly forward at its neck portion.

FIG. 4 also shows the location of the jaw hinge 36 from an overhead view.

Figure 5:
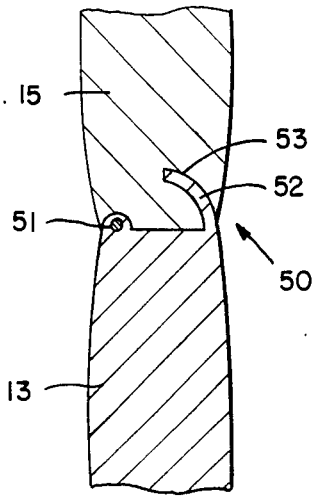
FIG. 5 is a sectional view of an elbow joint taken along line 5—5 of FIG. 1.
Figure 6:
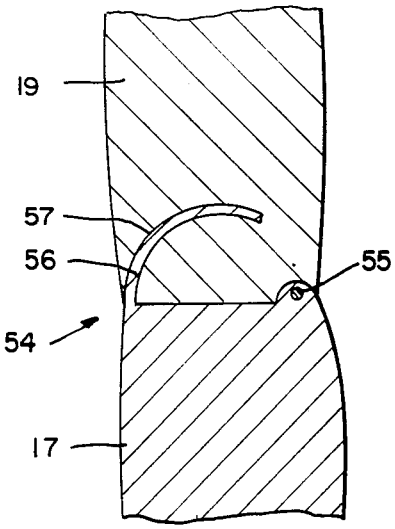
FIG. 6 is a sectional view of a knee joint as taken along line 6—6 of FIG. 1.

FIG. 5 shows the elbow joint 50 of the arm 14 and FIG. 6 shows the knee joint 54 of the leg 16 in a preferred embodiment of the invention. The arm 14 has an elbow hinge 51 which allows the forearm 13 to pivot about the bicep 15 upon manipulation of a control line 02 attached to a hook 44 (FIG. 1) on the forearm 13. An arcuate projection 52 extending from the top of the forearm 13 into a complementarily shaped recess 53 disposed in the bicep 15 serves to cover the gap produced in the joint when the forearm 13 is pivoted in relation to the bicep 15. This feature supplies a more realistic rendition of the appearance of a joint in operation.

The knee joint 54 in FIG. 6 shows a similar embodiment in the leg 16. The calf 17 is pivoted from thigh 19 about knee hinge 55, whereupon the arcuate projection 56 attached to calf 17 slides out of the complementarily shaped recess 57 in thigh 19, serving to cover the gap made in the joint.

Figure 7:
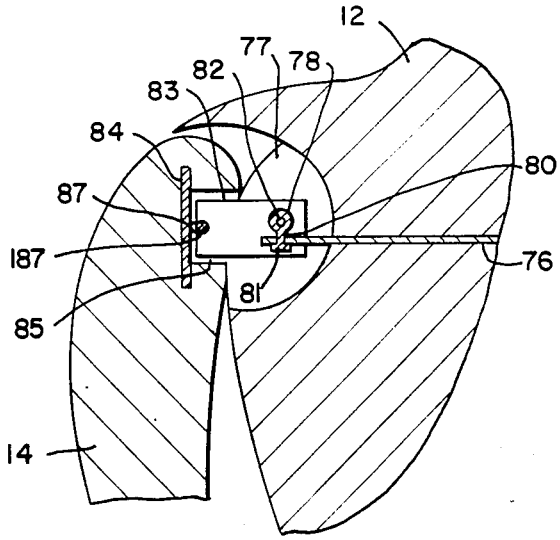
FIG. 7 is a sectional view of a shoulder portion of the marionette.
Figure 8:
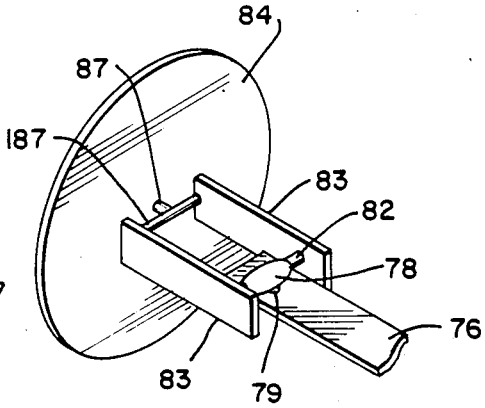
FIG. 8 is a top perspective view of the end of the shoulder joint mechanism.

FIGS. 7 and 8 show how the arms 14 are attached to and supported by the upper torso 12, and also show how shoulder movement is accomplished. A rectangular shoulder support bar 76 is horizontally disposed in the interior of the marionette 10 at chest height. It is also disposed horizontally in the sense that the longer sides of the rectangular shoulder support bar 76 (in cross section) are parallel to the ground. The ends of the bar extend out into shoulder cavities 77 of the marionette body 10. Located on the top side of this bar near each end is an elliptical shaft sleeve 78 rotatably attached to the shoulder support bar 76 by a pin 79 extending through a hole 80 in the shoulder support bar 76 and retained therein by a cap 81 larger in size than the diameter of the hole 80. The bore through the elliptical shaft sleeve 78 accepts a shaft 82, the ends of the shaft 82 are subsequently attached to two rectangular arm support bars 83 whose long sides (in cross section) are oriented perpendicularly to the ground (vertically disposed). The attachment of the shaft end to the support bar 76 may be made in various ways, depending on the materials of construction and required joint strength. These options would include gluing or a weldment among others.

These arm support bars 83 protrude outwardly from the shoulder cavities 77 and have a small rotating wheel 87 protruding from a rod 187 attached to the end of each arm support bar 84. The arm 14 is provided with a corresponding arm cavity 85 which holds a circular arm support disc 84. The arm support disc 84 is connected to the small rotating wheel 87, preferably by snap-on fit. The arm support disc 84 and rotating wheel 87 combination can rotate providing for a swinging-arm motion. As can be seen in FIG. 8, the arm 14 will also be capable of a "shoulder shrugging" motion due to the rotation of the shaft 82 inside the shaft sleeve 78, and will also have a limited range of "arm sway" motion as the shaft sleeve 78 may pivot about the pin 79 extending through the shoulder support bar 76.

Figure 9:
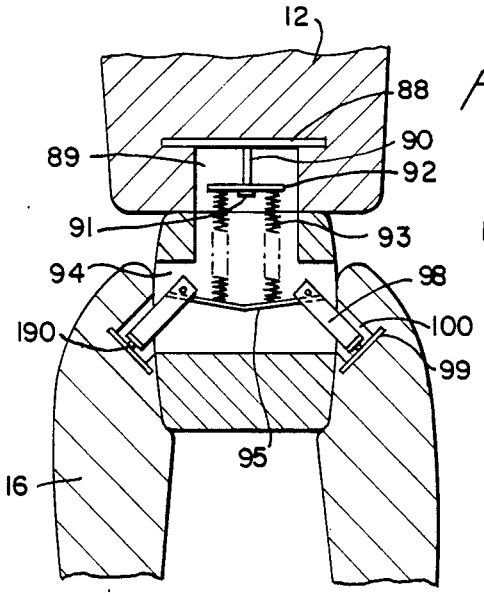
FIG. 9 is a sectional view taken along line 9—9 of FIG. 2.
Figure 10:
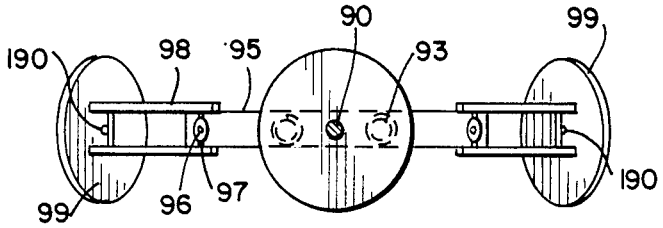
FIG. 10 is a top plan view of the hip joint mechanism.

FIGS. 9 and 10 show in detail the means by which the lower torso 22 and legs 16 are attached to the upper torso 12. A lower torso support 88 is disposed in and captively held in upper torso cavity 89. Attached to and projecting vertically downward from the lower torso support bar 88 is a cylindrical center rod 90 with flange 91. A rotating hip disc 92 rests on and is supported by the flange 91 and the disc in turn has two springs 93 attached to its underside. The springs extend down into a lower torso cavity 94. The other ends of the springs 93 are attached to a hip joint bar 95 which is a structural member analogous to the shoulder support bar 76 of FIG. 7, but it angles upward from the horizontal from the center to each end. The leg connecting joint is the same as the arm connection joint recited previously, with an elliptical shaft sleeve 96 rotatably attached to the hip joint bar 95 by a pin extending through a hole in the hip joint bar 95 and retained therein by a cap larger in size than the diameter of the hole. The bore through the elliptical shaft sleeve accepts a shaft 97, and the ends of the shaft 97 are subsequenly attached to two rectangular leg support bars 98.

The leg support bars 98 protrude outwardly from the lower torso cavity 94 and circular leg support discs 99 are snap-fit attached to small rotating wheels 190 attached to and protruding from the outer ends of the leg support bars 97. As can be seen in FIG. 9, the leg 16 has a corresponding leg cavity 100 which retains a leg support disc 99 and allows the leg support bars 98 to be inserted and attached to the leg 16.

Figure 11:
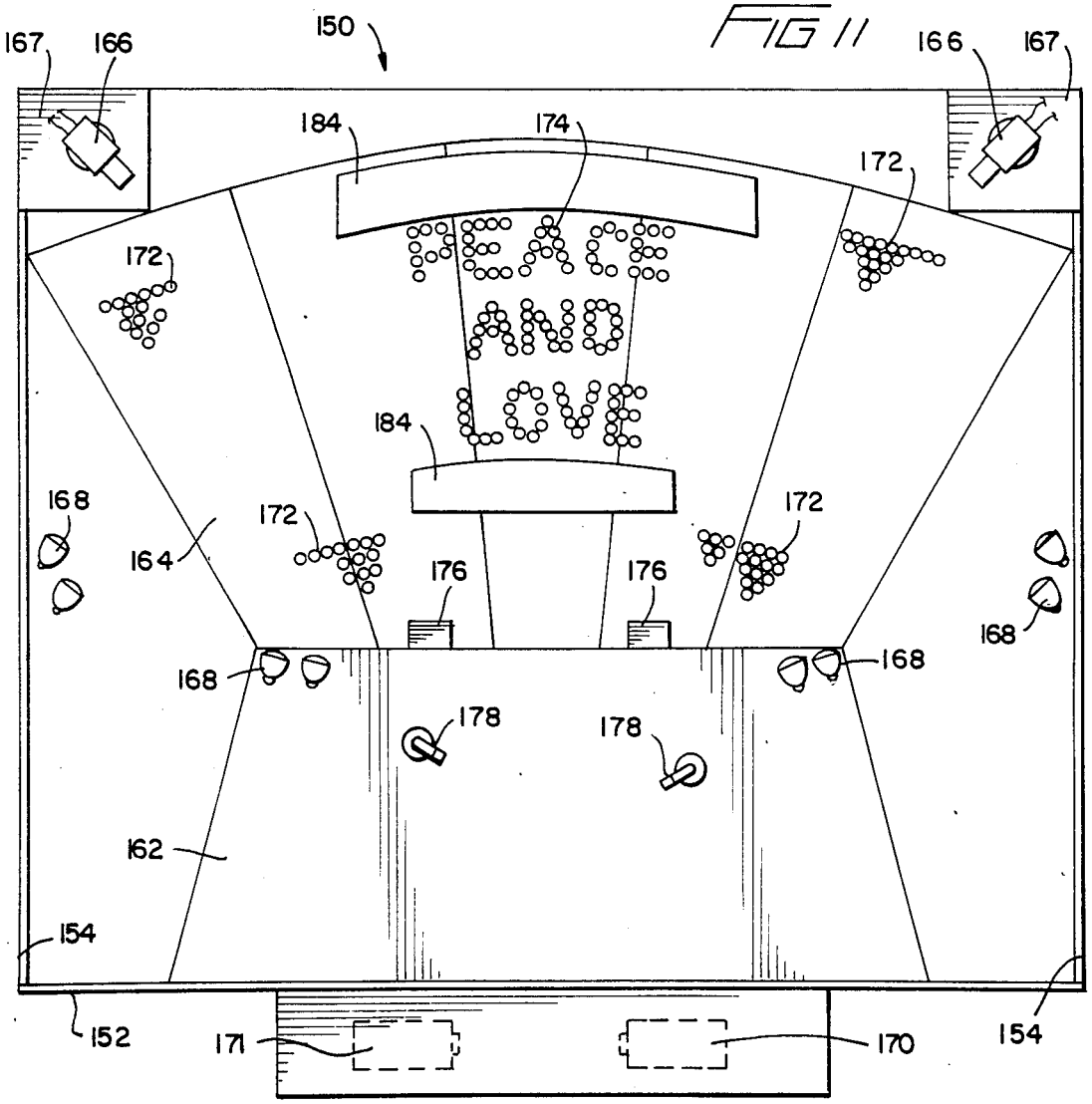
FIG. 11 is a top plan view of the theatre with stage and audience sections.

FIG. 11 is an overhead plan view of the theatre 150 provided with the marionette 10 in the preferred embodiment. A back wall 152 and two right angle side walls 154 extend vertically upward to a height at least as great as the height of the marionette 10 standing upright on the stage 162. The stage 162 is elevated from the audience section 164. Cameras 166 with or without miniature cameramen are placed on raised platforms 167 in the corners of the theatre 150 farthest from the stage 162. Operating lights 168 are disposed at various locations in the theatre 150, and trained on either the stage 162 or audience area 164. A power compartment 170 located behind the back wall 152 houses batteries 171 which power the lights. This compartment may also have a wire and plug running from the outside, connected into the circuitry for use with household alternating current. It is also preferred that the power compartment 170 be equipped to receive an audio input line, and an output line for connection to the speaker 62 in the marionette 10.

The audience area 164 is styled to make it appear as if people were in the audience area 164 watching the show. Different ways of doing this would include using differently colored dots on the surface, using short wooden pegs protruding from the surface, or using small simple plastic figurines protruding from the surface. The pegs or figurines would also be colored to resemble, to some extent, human bodies. This can be done by painting peach dots where the faces belong, painting the head areas in a normal hair color and painting the lower portions in a solid color to look roughly like clothing. A further entertaining feature of the audience area 164 is provided in that among the standard colored people 172 are interspersed fluorescently colored people 174 which may glow in the dark, or will stand out more than the standard colored people 172 when the lights 168 are on. More specifically, these fluorescently colored people 174 are positioned to spell out a message. Thus, when the theatre lights 168 are turned off, the fluorescently colored people 174 will glow, prominently spelling out the prescribed message. If pegs or figurines were used, it would be possible to provide one section of the audience with removable pegs, thus allowing different messages to be displayed.

A mirror 184 is disposed in the audience area 162 and positioned at an angle which will allow the marionette operator to view a reflection of the marionette 10 while he or she is operating it.

Stage speakers 176 at the front of the stage 162 can either be real and used in conjunction with the loudspeaker 62 of the marionette 10, or merely to simulate the appearance of stage speakers. Dummy microphones 178 are also provided on the stage 162 in furtherance of simulating live performances.

Figure 12:
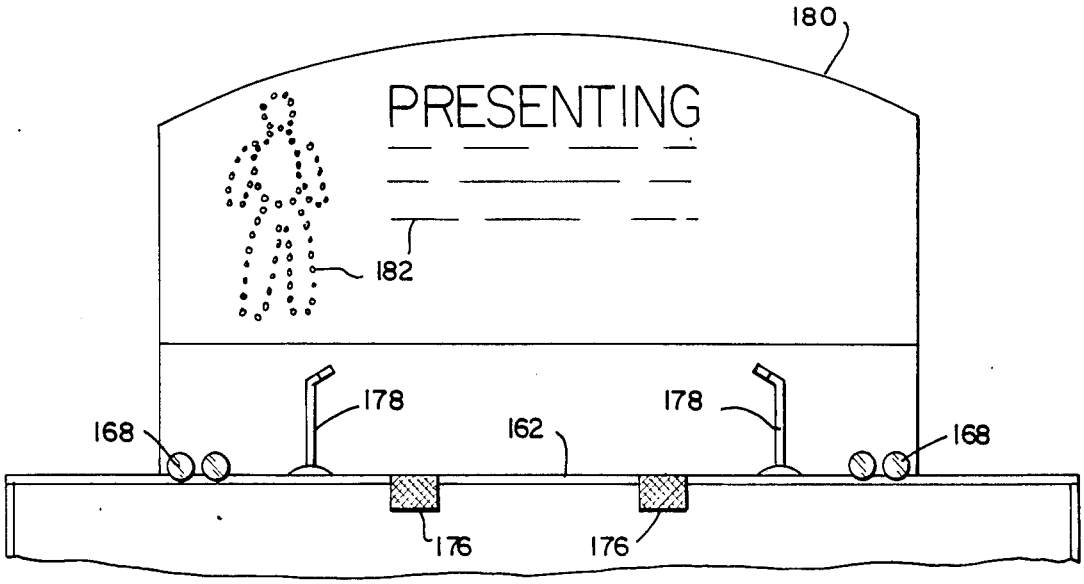
FIG. 12 is a partial front elevation view of the theatre showing the stage and backdrop for the stage.

FIG. 12 shows the stage 162 as it would appear to the audience. The lights 168, speakers 176 and microphones 178 are shown here in elevation and correspond to like objects shown in FIG. 11. The stage presentation wall 180 may or may not be integral with the back wall 152 of the theatre 150. The stage presentation wall 180 is wired to the power compartment 170 such that billboard lights 182 may be illuminated to spell out the entertainer's name and, if desired, an outline of the performing marionette 10.

It will be apparent to those skilled in the art that various modifications may be made in this invention without departing from its spirit and scope. Accordingly, the foregoing description is to be construed as illustrative only, rather than limiting, and the invention shall be limited only by the scope of the appended claims which follow.

I Claim:

1. An amusement device comprising:

a marionette body suspended by a plurality of control lines, said control lines being attached at their lower ends to said body and one or more limbs, said control lines having upper ends disposed for use by an operator, said body being capable of suspension exclusive of any control line attached to a head of said body;

said head attached to said body at an upper torso, said head having a lower attached portion and an upper movable portion;

a head actuation line attached at a lower end to said upper movable portion, and having an upper end disposed for use by an operator;

pivot means connecting said upper movable portion to said lower attached portion, allowing said upper movable portion to pivot about said lower attached portion when said head actuation line is raised and lowered; and sound producing means disposed in said head, said sound producing means being in communication with an audio input signal source.

2. An amusement device as described in claim 1 wherein said sound producing means further comprises a loudspeaker, said loudspeaker connected to said audio source by wire.

3. An amusement device as described in claim 2 wherein said loudspeaker is disposed in a recess formed in a top surface of said lower attached portion.

4. An amusement device as described in claim 1, wherein at least one hand of said marionette is made of a magnetic material.

5. An amusement device as described in claim 1 wherein said marionette is provided with elbow and knee joints, each of said joints having an arcuate projection extending from a first part of an associated arm or leg, said projection being received in a complementary recess in a second part of said associated arm or leg.

6. An amusement device as described in claim 1, further comprising a proportionately sized theatre, said theatre having a stage, a stage presentation wall, an audience section, a plurality of lights, and a power source.

7. An amusement device comprising:

a marionette body suspended by a plurality of control lines, said control lines being attached at their lower ends to said body and at least one limb extending from said body, upper ends of said control lines being disposed for use by an operator, said control lines being capable of supporting said body independently of any control line attached to a head of said body;

said head attached to said body at an upper torso, said head having a lower attached portion and an upper movable portion, a front of said lower attached portion further appearing to resemble a face from a lower lip down to a neck of a human, a front of said upper movable section further appearing to resemble a face from an upper lip to a scalp of a human; said head being capable of 360° rotation, said upper torso having a neck portion which is angled slightly forward from vertical;

a head actuation line attached at a lower end to said upper movable portion, and having an upper end disposed for use by an operator;

pivot means connecting said upper movable portion to said lower attached portion, allowing said upper movable portion to pivot from an initial position wherein said front of said upper movable portion rests on said front of said lower attached portion to a position where said front of said upper movable portion is spaced apart from said front of said lower attached portion, revealing a mouth in said head when said head actuation line is raised, and allowing return to said initial position when said head actuation line is subsequently lowered; and a loudspeaker disposed in a recess formed in a top surface of said lower attached portion, said loudspeaker being connected to an audio input signal source by wire.

8. An amusement device as described in claim 7, further comprising a theatre, said theatre having a stage, a vertically projecting stage presentation wall behind said stage, said stage presentation wall having means for displaying information, vertically projecting side walls joined to said stage presentation wall along vertical edges, an audience section covering an area bounded by the base of said stage, and the bases of said two side walls, a plurality of lights, a power source, and a plurality of proportionately sized non-working microphones, speakers, and television cameras.

9. An amusement device as described in claim 6 or 8, wherein said audience section has a first and second set of people disposed in said audience section, said first set being colored with non-fluorescent colors, said second set being colored with fluorescent colors.

10. An amusement device as described in claim 9, wherein said second set of people are interspersed within said first set, said second set being specifically disposed in locations where said second set will form letters or words, said second set being more highly visible than said first set.

11. An amusement device comprising:

a marionette in combination with a theatre, said theatre having a stage, a stage presentation wall, behind said stage means for displaying information relating to said marionette on said wall, an audience section, a first and second set of people disposed in said audience section, said first set being colored with non-fluorescent colors, said second set being colored with fluorescent colors, said second set further being specifically disposed in locations to form letters or words, a plurality of lights and a power source for said lights.

* * * * *